US008967434B2

(12) United States Patent
Lewandowski et al.

(10) Patent No.: US 8,967,434 B2
(45) Date of Patent: Mar. 3, 2015

(54) SELF-ADJUSTING HANDLE FOR SPRAY BOTTLES

(75) Inventors: Valerie R. Lewandowski, Naples, FL (US); Tyler W. Fyke, Naples, FL (US)

(73) Assignee: L&F Innoventions LLC, Naples, FL (US)

( * ) Notice: Subject to any disclaimer, the term of this patent is extended or adjusted under 35 U.S.C. 154(b) by 823 days.

(21) Appl. No.: 12/895,982

(22) Filed: Oct. 1, 2010

(65) Prior Publication Data

US 2011/0315717 A1 Dec. 29, 2011

Related U.S. Application Data

(60) Provisional application No. 61/357,988, filed on Jun. 24, 2010.

(51) Int. Cl.

| | |
|---|---|
| ***B05B 15/00*** | (2006.01) |
| ***B05B 15/06*** | (2006.01) |
| *B05B 11/00* | (2006.01) |

(52) U.S. Cl.

CPC ..... *B05B 15/066* (2013.01); *B05B 11/3011* (2013.01); *B05B 11/3057* (2013.01)

USPC ..... 222/383.1; 239/587.4; 239/587.1

(58) Field of Classification Search

CPC B05B 15/066; B05B 15/067; B05B 11/0059; B05B 11/3057; B05B 15/005; B05B 11/0037; F16L 27/02

USPC ..... 222/382, 383.1, 464.4, 464.6, 526; 239/334, 587.4

See application file for complete search history.

(56) References Cited

U.S. PATENT DOCUMENTS

| | | | | |
|---|---|---|---|---|
| 2,456,182 | A | 12/1948 | Goble | |
| 2,647,796 | A | 8/1953 | Ziherl | |
| 2,904,356 | A * | 9/1959 | Love | 285/226 |
| 3,907,337 | A * | 9/1975 | Affa | 285/114 |
| 3,921,912 | A * | 11/1975 | Hayes | 239/242 |
| 3,926,341 | A | 12/1975 | Lhoest | |
| 4,035,004 | A | 7/1977 | Hengesbach | |
| 4,256,154 | A | 3/1981 | Black | |
| 4,558,821 | A | 12/1985 | Tada et al. | |
| 4,564,224 | A * | 1/1986 | Korus | 285/272 |
| 4,618,076 | A | 10/1986 | Silvenis | |
| 4,652,025 | A * | 3/1987 | Conroy, Sr. | 285/114 |
| 4,705,191 | A | 11/1987 | Itzel et al. | |

(Continued)

FOREIGN PATENT DOCUMENTS

| | | |
|---|---|---|
| CN | 101474606 | 7/2009 |
| GB | 2353828 | 3/2001 |
| JP | 9192554 | 7/1997 |

*Primary Examiner* — Paul R Durand
*Assistant Examiner* — Charles P Cheyney
(74) *Attorney, Agent, or Firm* — NKK Patent Law, PLLC

(57) ABSTRACT

A self-adjusting handle (2) for a spray bottle (1) having a head (5) extending from a handle (2) that is attached to a cap (6) via a pivot joint (4), a ball joint (15) or a universal joint (20). The cap is attached to a reservoir (7) having a threaded portion that screws into a threaded portion (13) of the cap. A trigger lever (8) located on the head activates a pump (9). The pump is attached to a supply tube (10) that draws fluid from the reservoir. The pump 9 forces liquid up through the supply tube, through a barrel (11) and out a nozzle (12). The pivot joint, a ball joint and universal joint allow a user to pivot the head forward or backward while the reservoir remains in an upright position, thereby ensuring that the bottom of the supply tube maintains constant contact with the liquid in the reservoir.

8 Claims, 3 Drawing Sheets

(56) References Cited

U.S. PATENT DOCUMENTS

| | | | | |
|---|---|---|---|---|
| 4,781,311 | A | 11/1988 | Dunning et al. | |
| 4,830,235 | A | 5/1989 | Miller | |
| 4,925,066 | A | 5/1990 | Rosenbaum | |
| 5,031,798 | A | 7/1991 | Wild | |
| 5,072,884 | A | 12/1991 | Ellison et al. | |
| 5,083,678 | A | 1/1992 | Waring | |
| 5,102,051 | A * | 4/1992 | Smith et al. | 239/297 |
| 5,149,146 | A | 9/1992 | Simoni | |
| 5,152,431 | A | 10/1992 | Gardner et al. | |
| 5,156,295 | A | 10/1992 | Gordon et al. | |
| 5,156,299 | A | 10/1992 | De Caluwe et al. | |
| 5,160,071 | A | 11/1992 | Wright | |
| 5,195,664 | A | 3/1993 | Rhea | |
| 5,244,125 | A | 9/1993 | Robbins, III | |
| 5,251,820 | A | 10/1993 | Ho | |
| 5,337,921 | A | 8/1994 | Wilson et al. | |
| 5,398,846 | A | 3/1995 | Corba et al. | |
| 5,421,485 | A | 6/1995 | Furuta et al. | |
| 5,429,254 | A | 7/1995 | Christine | |
| 5,439,141 | A | 8/1995 | Clark et al. | |
| 5,472,119 | A | 12/1995 | Park et al. | |
| 5,474,212 | A | 12/1995 | Ichikawa et al. | |
| 5,478,015 | A | 12/1995 | Black | |
| 5,542,581 | A | 8/1996 | Habora et al. | |
| 5,558,257 | A | 9/1996 | Braun | |
| 5,718,383 | A | 2/1998 | Smith et al. | |
| 5,836,479 | A | 11/1998 | Klima et al. | |
| 5,839,616 | A | 11/1998 | Irwin et al. | |
| 5,871,122 | A | 2/1999 | Klima et al. | |
| 5,890,624 | A | 4/1999 | Klima et al. | |
| 5,934,519 | A | 8/1999 | Kim et al. | |
| 5,944,223 | A | 8/1999 | Klima et al. | |
| 5,947,332 | A | 9/1999 | Klima, Jr. et al. | |
| 5,979,715 | A | 11/1999 | Emrick | |
| 5,984,199 | A | 11/1999 | Restive | |
| 6,027,041 | A * | 2/2000 | Evans | 239/334 |
| 6,059,152 | A | 5/2000 | Mayfield | |
| 6,123,230 | A | 9/2000 | Klima, Jr. et al. | |
| 6,179,142 | B1 | 1/2001 | Hansen | |
| 6,206,243 | B1 | 3/2001 | Schneider et al. | |
| 6,213,358 | B1 | 4/2001 | Libit et al. | |
| 6,250,511 | B1 | 6/2001 | Kelly | |
| 6,253,993 | B1 | 7/2001 | Lloyd et al. | |
| 6,264,121 | B1 * | 7/2001 | McClary | 239/525 |
| 6,319,453 | B1 | 11/2001 | Klima, Jr. et al. | |
| 6,345,774 | B1 | 2/2002 | Calhoun | |
| 6,394,319 | B1 | 5/2002 | Pucillo | |
| 6,409,103 | B1 | 6/2002 | Norville et al. | |
| 6,508,415 | B2 | 1/2003 | Wang | |
| 6,540,109 | B1 | 4/2003 | Klima et al. | |
| 6,592,057 | B1 | 7/2003 | Ericksen et al. | |
| 6,631,830 | B2 | 10/2003 | Ma et al. | |
| 6,659,670 | B1 | 12/2003 | Blouse | |
| 6,732,958 | B2 | 5/2004 | Norville et al. | |
| 6,789,303 | B2 | 9/2004 | Maas et al. | |
| 6,833,072 | B1 | 12/2004 | Krestine et al. | |
| 6,834,815 | B2 | 12/2004 | Appleby | |
| 7,040,510 | B1 | 5/2006 | Hester | |
| 7,124,915 | B2 * | 10/2006 | Restive | 222/153.11 |
| 7,316,362 | B2 | 1/2008 | Miyauchi | |
| 7,478,738 | B2 | 1/2009 | Hood et al. | |
| 7,520,447 | B2 | 4/2009 | Engelen et al. | |
| 7,648,083 | B2 | 1/2010 | Hornsby et al. | |
| 7,717,306 | B2 | 5/2010 | White, Sr. | |
| 8,052,071 | B2 * | 11/2011 | Kruse | 239/345 |
| 8,157,131 | B2 | 4/2012 | Sim | |
| 2001/0011661 | A1 | 8/2001 | Klima et al. | |
| 2002/0031625 | A1 | 3/2002 | Klima, Jr. et al. | |
| 2003/0038186 | A1 | 2/2003 | Klima et al. | |
| 2004/0035819 | A1 | 2/2004 | Dennison | |
| 2004/0104194 | A1 | 6/2004 | Dennison | |
| 2004/0245208 | A1 | 12/2004 | Dennison | |
| 2005/0167442 | A1 | 8/2005 | Cuisinier | |
| 2006/0237485 | A1 | 10/2006 | An | |
| 2007/0215645 | A1 | 9/2007 | Clynes et al. | |
| 2007/0235472 | A1 | 10/2007 | McFarland | |
| 2008/0011779 | A1 | 1/2008 | Klima et al. | |
| 2008/0245824 | A1 | 10/2008 | Lyles | |
| 2008/0279611 | A1 | 11/2008 | Graphenious | |
| 2008/0315018 | A1 | 12/2008 | Withers | |
| 2009/0212077 | A1 | 8/2009 | Carden | |
| 2009/0277928 | A1 | 11/2009 | Bruckner | |
| 2010/0096414 | A1 | 4/2010 | Dennis | |
| 2010/0096415 | A1 | 4/2010 | Dennis | |
| 2010/0270334 | A1 * | 10/2010 | Gioia | 222/377 |
| 2011/0062185 | A1 | 3/2011 | McFarland | |
| 2011/0121039 | A1 | 5/2011 | Dennis | |
| 2011/0158740 | A1 | 6/2011 | Kandasamy et al. | |
| 2011/0180101 | A1 | 7/2011 | Konishi et al. | |
| 2011/0180619 | A1 | 7/2011 | Konishi et al. | |

* cited by examiner

SELF-ADJUSTING HANDLE FOR SPRAY BOTTLES

CROSS REFERENCE TO RELATED APPLICATION

This application claims the benefit of U.S. Provisional Patent Application No. 61/357,988, filed Jun. 24, 2010. The patent application identified above is incorporated here by reference in its entirety to provide continuity of disclosure.

BACKGROUND OF THE INVENTION

This invention relates to the spray bottles, more particularly, a self-adjusting spray nozzle handle for spray bottles that allows a user to use the spray bottle at any angle while maintaining constant contact between the supply tube and the liquid contained within the spray bottle.

Conventional spray bottles are commonly used for a variety of applications. Conventional spray bottles often comprise a head that screws onto a bottle or reservoir. The spray-bottle head comprises a trigger lever that activates a small pump. The pump is attached to a supply tube that draws fluid from the bottom of the reservoir. The pump forces this liquid up through the supply tube, through a narrow barrel and out a nozzle. A problem arises with conventional spray bottles when the spray bottle is used at different angles. For example, if a user is spraying a horizontal surface, such as a floor, then the spray bottle must be placed in an angled or horizontal position. This causes the liquid within the reservoir to shift away from the end of the supply tube, thereby causing the tube to suck in only air.

Therefore, a need exists for a spray bottle having a head that allows the spray bottle to be used at any angle.

The relevant prior art includes the following patent references:

| Patent/Ser. No. (U.S. unless stated otherwise) | Inventor | Issue/Publication Date |
|---|---|---|
| CN101474606 | Li et al. | Jul. 08, 2009 |
| 2008/0245824 | Lyles | Oct. 09, 2008 |
| 7,316,362 | Miyauchi | Jan. 08, 2008 |
| 2006/0237485 | An | Oct. 26, 2006 |
| 6,732,958 | Norville et al. | May 11, 2004 |
| 6,592,057 | Ericksen et al. | Jul. 15, 2003 |
| 6,508,415 | Wang | Jan. 21, 2003 |
| 6,409,103 | Norville et al. | Jun. 25, 2002 |
| GB2353828 | Ridehalgh et al. | Mar. 07, 2001 |
| 6,027,041 | Evans | Feb. 22, 2000 |
| JP9192554 | Michio | Jul. 29, 1997 |
| 5,195,664 | Rhea | Mar. 23, 1993 |
| 5,149,146 | Simoni | Sep. 22, 1992 |
| 5,072,884 | Ellison et al. | Dec. 17, 1991 |
| 4,035,004 | Hengesbach | Jul. 12, 1977 |
| 2,647,796 | Ziherl | Aug. 04, 1953 |
| 2,456,182 | Goble | Dec. 14, 1948 |

SUMMARY OF THE INVENTION

The primary object of the present invention is to provide a self-adjusting handle for spray bottles that allows the spray bottle to be used at any angle of spraying.

Another object of the present invention is to provide a self-adjusting handle for spray bottles that allows a user to spray liquid from the spray bottle when it is less than full or near empty.

The present invention fulfills the above and other objects by providing a spray bottle comprising a head having a threaded portion that screws onto a reservoir having a corresponding threaded portion. The spray bottle head comprises a trigger lever that activates a small pump. The pump is attached to a supply tube that draws fluid from the bottom of the reservoir. The pump forces this liquid up through the supply tube, through a narrow barrel and out a nozzle. A special coupling means, such as a pivot joint, a ball joint, a universal joint, etc., located on the lower portion of the head allows a user to tilt the head while the reservoir remains in a vertical position, thereby ensuring that the bottom of the supply tube maintains constant contact with the liquid in the reservoir.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
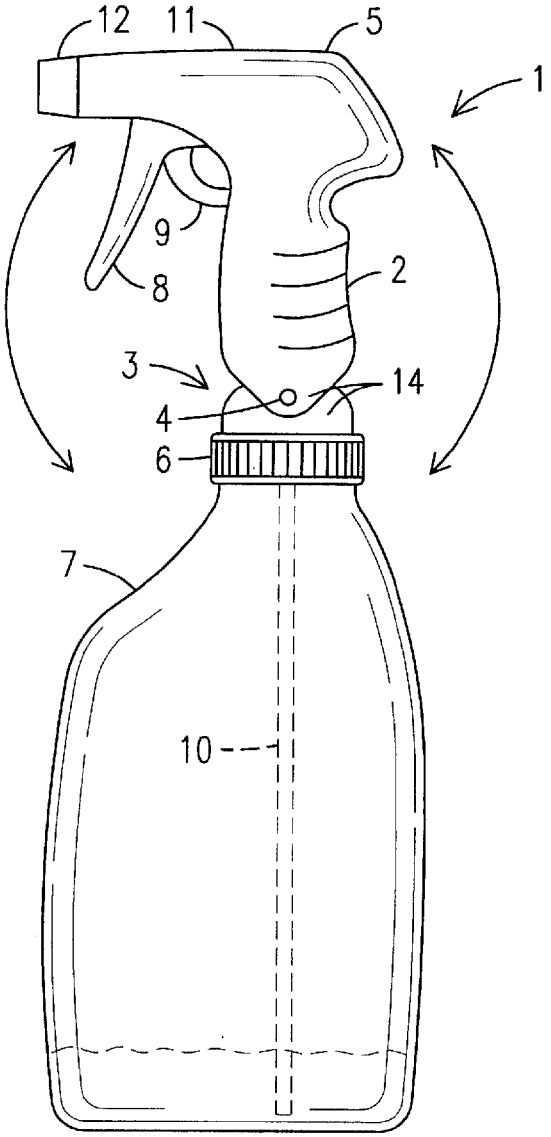
FIG. 1 is a side view of a spray bottle having a self-adjusting handle of the present invention in which the adjusting means is a pivot point.

For purposes of describing the preferred embodiment, the terminology used in reference to the numbered components in the drawings is as follows:

| | |
|---|---|
| 1. | spray bottle |
| 2. | self-adjusting handle |
| 3. | adjusting means |
| 4. | pivot point |
| 5. | head |
| 6. | cap |
| 7. | reservoir |
| 8. | trigger lever |
| 9. | pump |
| 10. | supply tube |
| 11. | barrel |
| 12. | nozzle |

-continued

| | |
|---|---|
| 13. | threaded portion of cap |
| 14. | tab |
| 15. | ball joint |
| 16. | ball |
| 17. | socket |
| 18. | partition |
| 19. | aperture |
| 20. | universal joint |
| 21. | spacer |

Figure 2:
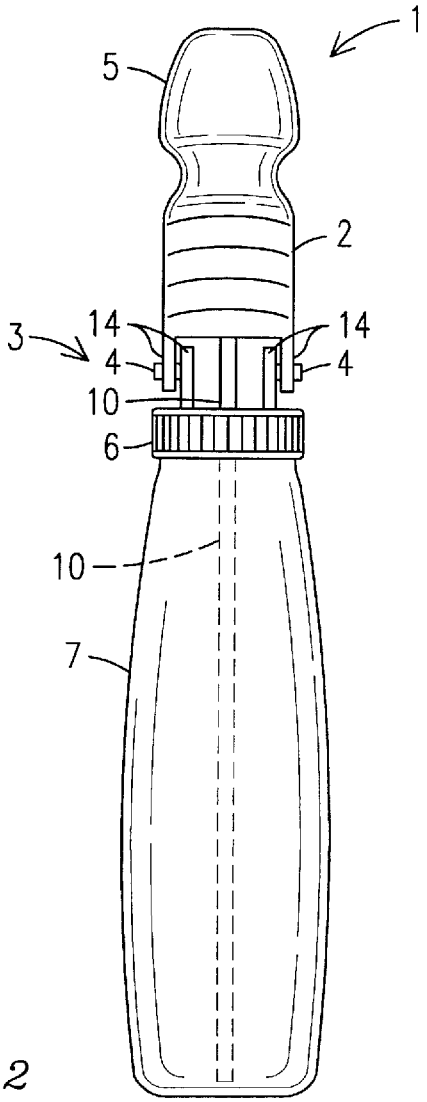
FIG. 2 is a rear view of a spray bottle having a self-adjusting handle of the present invention in which the adjusting means is a pivot point.
Figure 5:
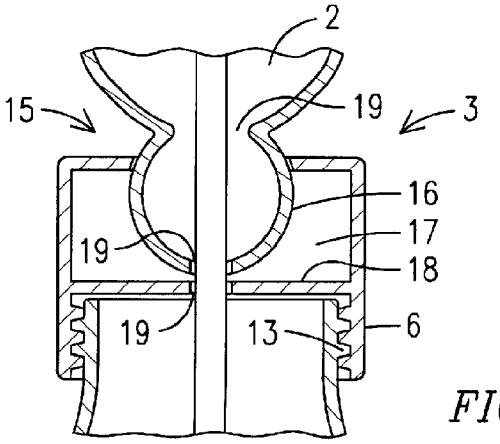
FIG. 5 is a cross-section view along line 5-5 of FIG. 4 showing a ball joint of the present invention.

With reference to FIGS. 1 and 2, a front view and a rear view of a spray bottle 1 having a self-adjusting handle 2 of the present invention in which the adjusting means 3 is a pivot point 4, respectively, are shown. The spray bottle 1 comprises a head 5 extending from the handle 2 that is attached to a cap 6 via the adjusting means 3. The cap is attached to a reservoir 7 having a threaded portion that screws into a threaded portion 13 of the cap 6, as shown in FIG. 5. A trigger lever 8 located on the head 5 activates a pump 9. The pump 9 is attached to a supply tube 10 that draws fluid from the reservoir 7. The pump 9 forces this liquid up through the supply tube 10, through a barrel 11 and out a nozzle 12. The adjusting means 3 allows a user to pivot the head forward or backward while the reservoir 7 remains in an upright position. As shown here, the adjusting means 3 comprises pivot points 4 that attach the handle 2 having tabs 14 extending downward from the handle 2 to tabs 14 extending up from the cap 6. The pivot points 4 extent through the tabs 14 extending downward from the handle 2 and through the tabs 14 extending up from the cap 6.

Figure 3:
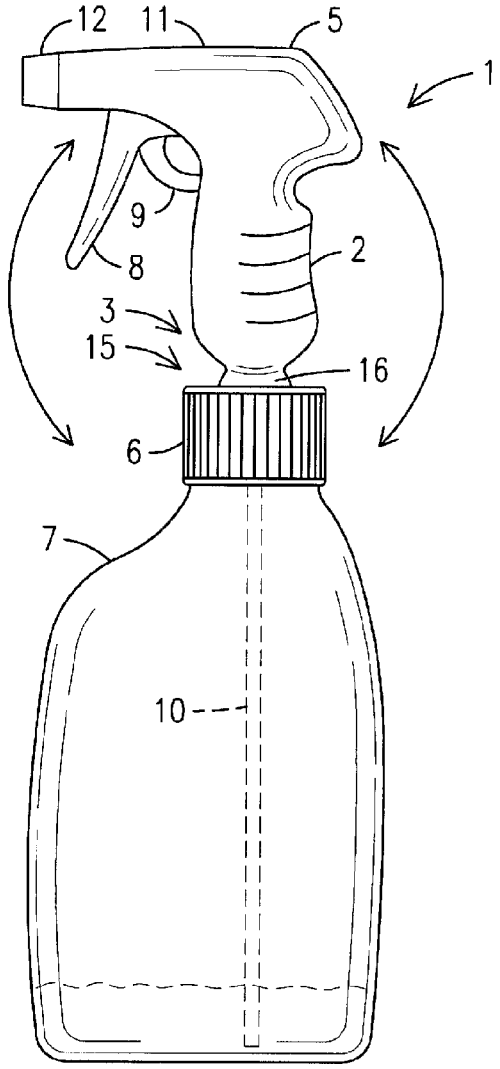
FIG. 3 is a side view of a spray bottle having a self-adjusting handle of the present invention in which the adjusting means is a ball joint.
Figure 4:
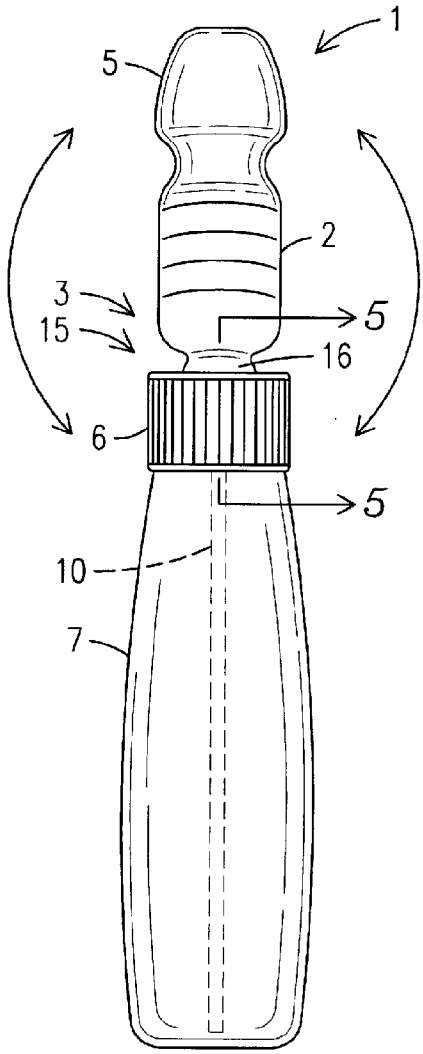
FIG. 4 is a rear view of a spray bottle having a self-adjusting handle of the present invention in which the adjusting means is a ball joint.

With reference to FIGS. 3, 4 and 5, a side view, a rear view and a cross-section view of a spray bottle 1 having a self-adjusting handle 2 of the present invention in which the adjusting means 3 is a ball joint 15, respectively, are shown. The spray bottle 1 comprises a head 5 extending from the handle 2 that is attached to a cap 6 via the adjusting means 3. The cap is attached to a reservoir 7 having a threaded portion that screws into a threaded portion 13 of the cap 6. A trigger lever 8 located on the head 5 activates a pump 9. The pump 9 is attached to a supply tube 10 that draws fluid from the reservoir 7. The pump 9 forces this liquid up through the supply tube 10, through a barrel 11 and out a nozzle 12. The adjusting means 3 allows a user to pivot the head forward, backward or side to side while the reservoir 7 remains in an upright position. As shown here, the adjusting means 3 is a ball joint 15 comprising a ball 16 extending downward from the handle 2 and located within a socket 17 extending upward from the cap 6. The socket 17 is separated from the threaded portion 13 of the cap 6 by a partition 18. The supply tube 10 passes through apertures 19 located in the partition 18 and in the ball 16.

Figure 6:
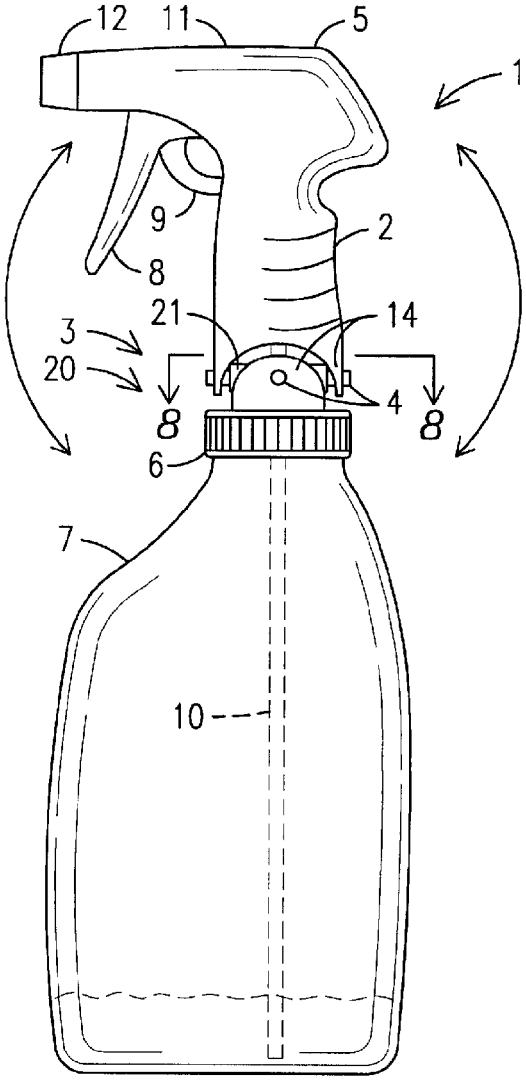
FIG. 6 is a side view of a spray bottle having a self-adjusting handle of the present invention in which the adjusting means is a universal joint.
Figure 7:
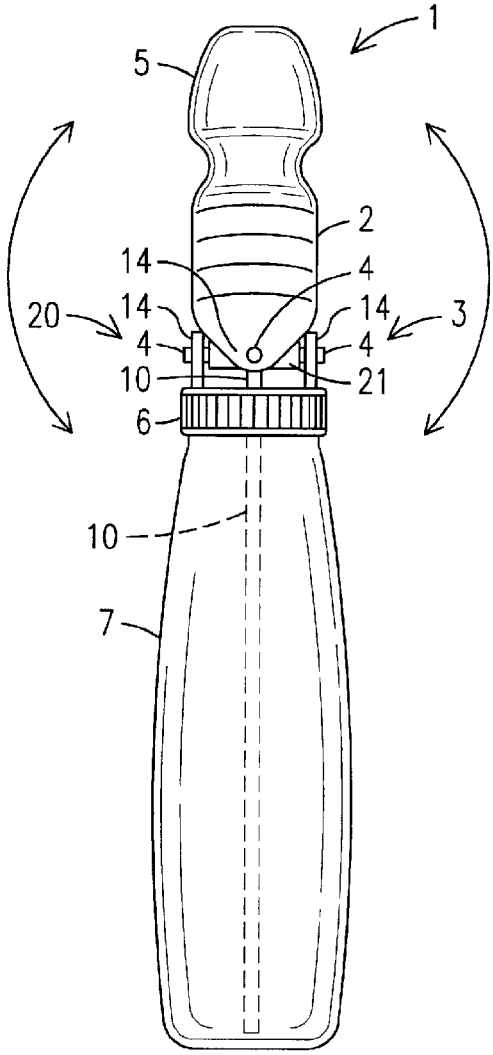
FIG. 7 is a rear view of a spray bottle having a self-adjusting handle of the present invention in which the adjusting means is a universal joint.
Figure 8:
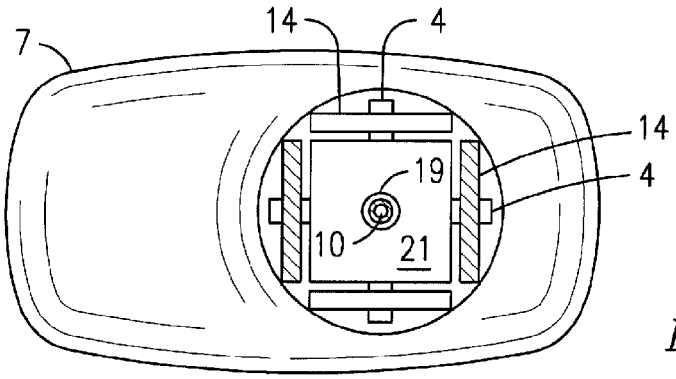
FIG. 8 is a cross-section view along line 8-8 of FIG. 7 showing a universal joint of the present invention.

Finally with reference to FIGS. 6, 7 and 8, a side view, a rear view and a cross-section view of a spray bottle 1 having a self-adjusting handle 2 of the present invention in which the adjusting means 3 is a universal joint 20, respectively, are shown. The spray bottle 1 comprises a head 5 extending from the handle 2 that is attached to a cap 6 via the adjusting means 3. The cap is attached to a reservoir 7 having a threaded portion that screws into a threaded portion 13 of the cap 6, as shown in FIG. 5. A trigger lever 8 located on the head 5 activates a pump 9. The pump 9 is attached to a supply tube 10 that draws fluid from the reservoir 7. The pump 9 forces this liquid up through the supply tube 10, through a barrel 11 and out a nozzle 12. The adjusting means 3 allows a user to pivot the head forward, backward or side to side while the reservoir 7 remains in an upright position. As shown here, the adjusting means 3 is a universal joint 20 comprising tabs 14 extending downward from the handle 2 and tabs 14 extending upward from the cap 6. The tabs 14 are connected to a spacer 21 by pivot points 4. The supply tube 10 passes through an aperture 19 located in the spacer 21.

It is to be understood that while a preferred embodiment of the invention is illustrated, it is not to be limited to the specific form or arrangement of parts or use herein described and shown. It will be apparent to those skilled in the art that various changes may be made without departing from the scope of the invention and the invention is considered not to be limited to what is shown and described in the specification and drawings.

We claim:

1. A spray bottle assembly comprising:

a reservoir for containing a liquid to be sprayed, the reservoir having an upper threaded portion;

a cap engaged with the upper threaded portion of the reservoir;

a spacer carried by the cap;

a first pivot point extending from a first side of the spacer and a second pivot point extending from a second side of the spacer;

a spray head assembly including a squeeze trigger that pumps fluid from the reservoir and having a pair of tabs that are pivotally engaged with the first pivot point and the second pivot point and defining a spray head for dispensing liquids and an elongate handle for being grasped by an operator, the elongate handle extending generally longitudinally and parallel relative to a length of the reservoir when in an upright position and defining a gripping surface between the spray head assembly and the pair of tabs such that the spray head assembly is longitudinally spaced-apart from the pair of tabs when the handle is in a generally upright position, wherein the spray head assembly extends generally laterally relative to the elongate handle, the squeeze trigger being generally parallel to the elongate handle and closely spaced-apart such that an operator may grasp the handle and the squeeze trigger with the same hand; and a supply line assembly extending from the spray head assembly into the reservoir, wherein the spray head assembly and the reservoir pivot relative to each other by way of the pivotal engagement of the tabs with the pivot points in only the fore and aft directions.

2. The assembly of claim 1, wherein a pin extends through the spacer, the pin having a first end defining the first pivot point and a second end defining the second pivot point.

3. A spray bottle assembly comprising:

a reservoir for containing a liquid to be sprayed;

a cap engaging the reservoir;

a spacer carried by the cap;

a spray head assembly including a squeeze trigger that pumps fluids from the reservoir and for dispensing liquids in a fore direction, the spray head assembly having a spray head for dispensing liquids and an elongate handle for being grasped by an operator and further defining a pivot point, the handle and the cap defining the pivot point between the handle and the reservoir, the elongate handle extending generally longitudinally and parallel relative to a length of the reservoir when in an upright position and defining a gripping surface between the spray head assembly and the pivot point such that the spray head assembly is longitudinally spaced-apart from the pair of tabs when the handle is in a generally upright position, wherein the spray head assembly extends generally laterally relative to the elongate handle, the squeeze trigger being generally parallel to the elongate handle and closely spaced-apart such that an operator may grasp the handle and the squeeze trigger with the same hand; and a supply line assembly extending from the spray head assembly into the reservoir and extending through an opening defined in the spacer; and wherein the spray head assembly pivots only in the fore and aft direction around the pivot point relative to the reservoir, and further wherein, the handle maintains its shape when pivoting in the fore and aft direction.

4. The assembly of claim 3, wherein a pin extends through the spacer, the pin having a first end defining the first pivot point and a second end defining the second pivot point.

5. The assembly of claim 3, wherein the spray head assembly includes a trigger connected to a pump that pumps fluid through a supply line assembly that extends from the spray head assembly into the reservoir.

6. The assembly of claim 1, wherein the wherein the spray head assembly and reservoir pivot relative to each other in only a fore and an aft direction.

7. A spray bottle assembly consisting of:

a reservoir for containing a liquid to be sprayed;

a cap engaging the reservoir;

a spray head assembly for dispensing liquids in a fore direction, the spray head assembly including:

a spray head for dispensing liquids;

a squeeze trigger that pumps fluid from the reservoir; and an elongate handle extending perpendicularly from a length of the spray head and being configured for being grasped by the hand of an operator;

a pivot point defined between a reservoir facing side of the spray handle and a handle facing side of the cap, the pivot point allowing movement of the spray head assembly relative to the reservoir in only the fore and aft position;

a supply line assembly extending from the spray head assembly into the reservoir; and wherein the handle maintains its shape when pivoting in the fore and aft direction, wherein the elongate handle extends generally longitudinally and parallel relative to a length of the reservoir when in an upright position and defines a gripping surface between the spray head assembly and the pivot point such that the spray head assembly is longitudinally spaced-apart from the pivot point when the handle is in a generally upright position, wherein the spray head assembly extends generally laterally relative to the elongate handle, the squeeze trigger being generally parallel to the elongate handle and closely-spaced-apart such that an operator may grasp the handle and the squeeze trigger with the same hand.

8. A spray bottle assembly comprising:

a reservoir for containing a liquid to be sprayed;

a cap engaging the reservoir;

a spacer carried by the cap and defining an opening therethrough;

a spray head assembly defining:

a spray head for dispensing fluids;

a squeeze trigger that pumps fluid from the reservoir; and an elongate handle extending therefrom for being grasped by an operator;

a supply line extending from the spray head through the opening in the spacer and into the reservoir, where fluid passes from the reservoir into the ambient through the supply line; and a pivot point defined between the elongate handle and the reservoir and providing only fore and aft pivoting movement of the spray head and handle relative to the reservoir wherein the elongate handle extends generally longitudinally and parallel relative to a length of the reservoir when in an upright position and defines a gripping surface between the spray head assembly and the pivot point such that the spray head assembly is longitudinally spaced-apart from the pivot point when the handle is in a generally upright position, wherein the spray head assembly extends generally laterally relative to the elongate handle, the squeeze trigger being generally parallel to the elongate handle and closely-spaced-apart such that an operator may grasp the handle and the squeeze trigger with the same hand.

* * * * *